US005787804A

United States Patent [19]

Brasa

[11] Patent Number: 5,787,804

[45] Date of Patent: Aug. 4, 1998

[54] SILK-SCREEN PRINTING MACHINE WITH SAFE REMOVAL OF THE PRINTED PRODUCT

[76] Inventor: Umberto Brasa, Via B. Oriani 22/6, Milan, Italy

[21] Appl. No.: 831,714

[22] Filed: Apr. 1, 1997

[30] Foreign Application Priority Data

Jan. 4, 1996 [IT] Italy ..... MI960246 U

[51] Int. Cl.[6] ..... B65H 29/10; B41F 15/16

[52] U.S. Cl. ..... 101/114

[58] Field of Search ..... 101/114, 115, 101/121, 123, 124

[56] References Cited

U.S. PATENT DOCUMENTS 5,480,133 1/1996 Motev et al. ..... 101/114

*Primary Examiner*—Edgar S. Burr
*Assistant Examiner*—Amanda B. Sandusky
*Attorney, Agent, or Firm*—IP Group of Pillsbury Madison & Sutro LLP

[57] ABSTRACT

A silk-screen printing machine with safe removal of the printed product including a support structure, a printing head provided with a doctor blade and scraper and on which a silk-screen frame can be positioned, a printing table and, located to the side of the printing table, an element for depositing and collecting the printed product, in which the printing table is provided with a plurality of grooves, into the grooves there being insertable gripping elements which can be moved between a position in correspondence with the depositing and collecting element and a position inside the grooves. In this manner the printed product can be manipulated without danger of scoring its totally printed upper surface.

5 Claims, 2 Drawing Sheets

SILK-SCREEN PRINTING MACHINE WITH SAFE REMOVAL OF THE PRINTED PRODUCT

BACKGROUND OF THE INVENTION

This invention relates to a silk-screen printing machine with safe removal of the printed product.

In a silk-screen printing machine the printing frame is positioned on a support surface for the product to be printed, and having effected the printing the product has to be removed by gripping it laterally on unprinted portions or by moving the support outside the printing head region.

In those machines which provide for removal of the support, such as rotary machines or the like, there is no problem even if the product is printed over its entire surface, because all the time required for its correct drying is available.

If however products are to be printed on machines with a fixed support surface for the product, it is currently not possible to immediately withdraw products printed over their entire surface from the support structure located below the printing head, without scoring or ruining the printed surface.

SUMMARY OF THE INVENTION

An object of the present invention is to provide a silk-screen printing machine offering safe removal of the printed product without the danger of scoring the totally printed surface.

A further object is to minimize or annul the down time required for drying a product silk-screen printed over its entire surface. These objects are attained according to the present invention by a silk-screen printing machine with safe removal of the printed product comprising a support structure, a printing head provided with a doctor blade and scraper and on which a silk-screen frame can be positioned, a printing table and, located to the side of said printing table, an element for depositing and collecting the printed product, characterised in that said printing table is provided with a plurality of grooves, into said grooves there being insertable gripping elements which can be moved between a position in correspondence with said depositing and collecting element and a position inside said grooves.

BRIEF DESCRIPTION OF THE DRAWING

The characteristics and advantages of a silk-screen printing machine with safe removal of the printed product according to the present invention will be more apparent from the description thereof given hereinafter by way of non-limiting example, with reference to the accompanying schematic drawings, in which.

DETAILED DESCRIPTION

The figures show a silk-screen printing machine with safe removal of the printed product formed in accordance with the present invention and indicated overall by 11.

Figure 1:
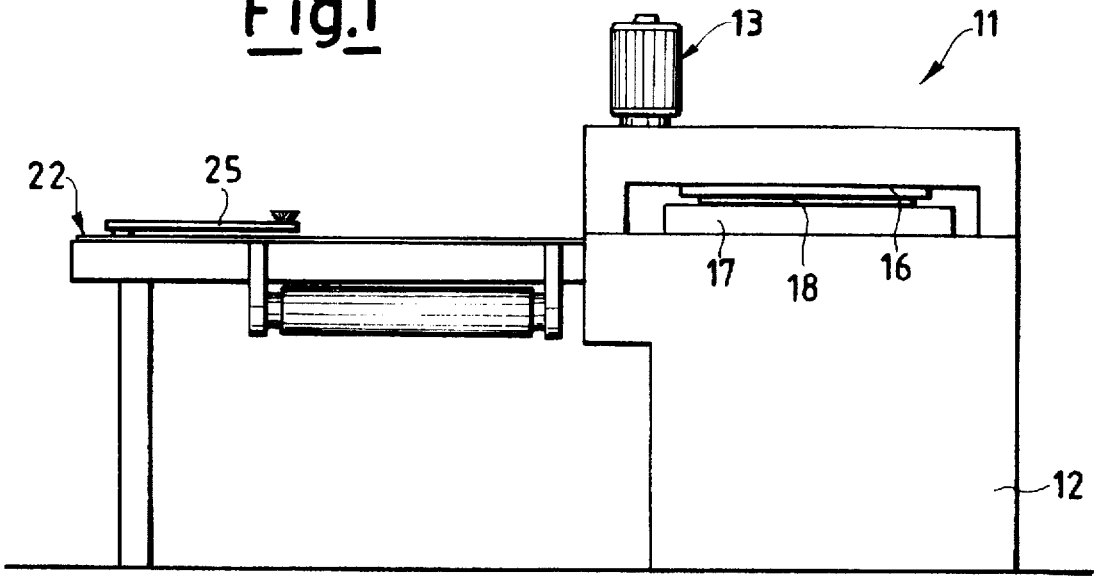
FIG. 1 is a side elevation of a machine of the present invention.
Figure 3:
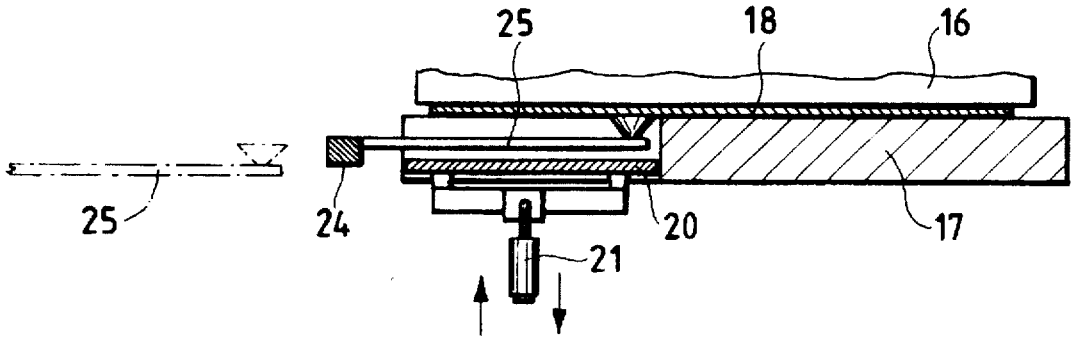
FIG. 3 is an enlarged section through a detail of the machine of the invention.
Figure 4:
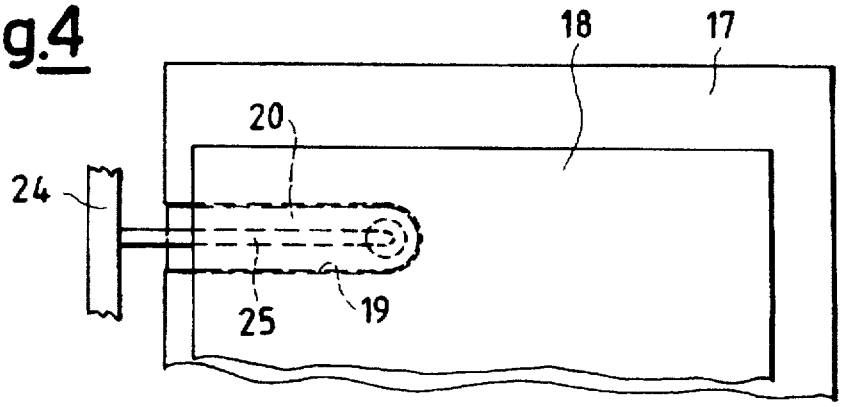
FIG. 4 is a plan view from above of the detail of the machine of the invention shown in FIG. 3.
Figure 2:
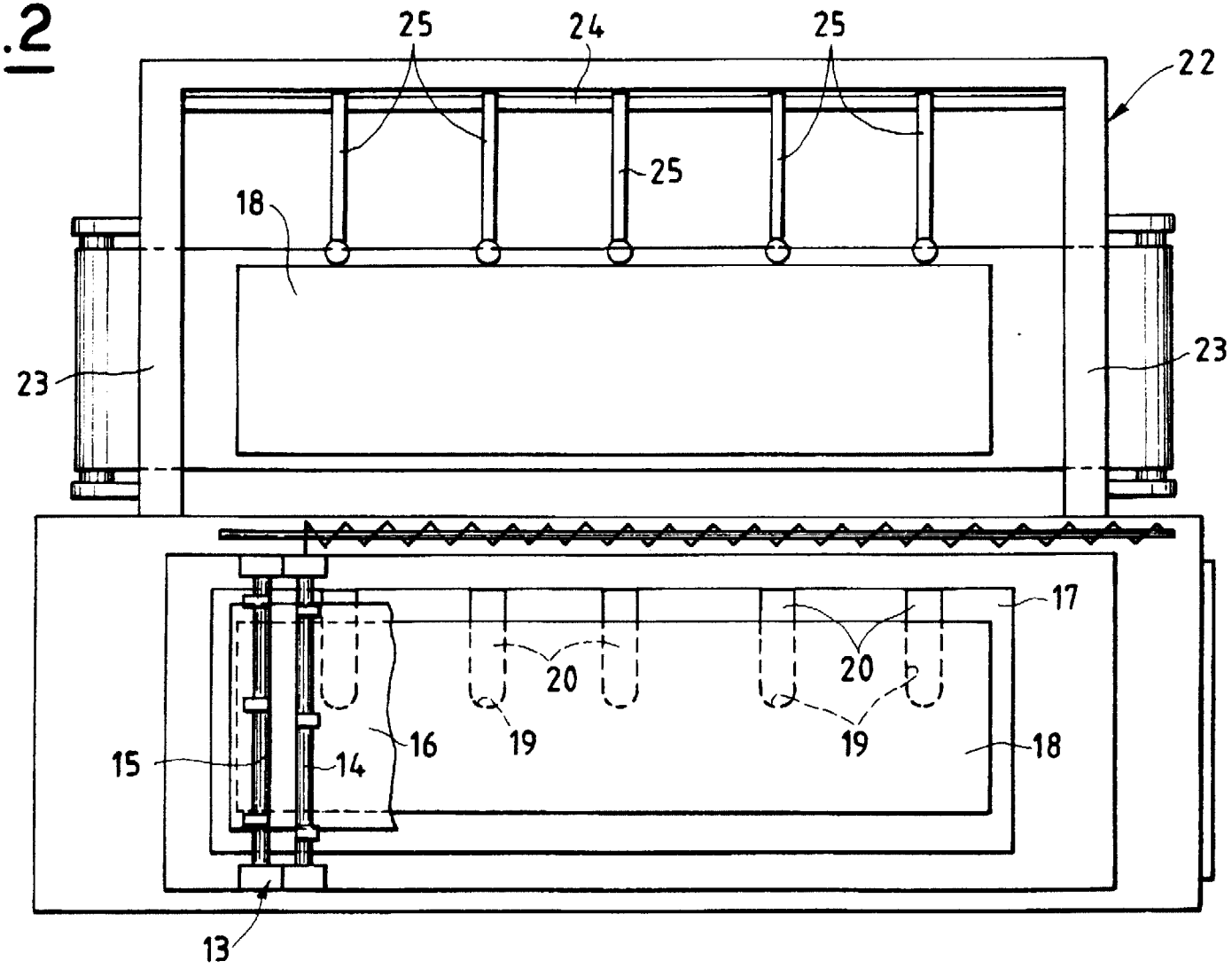
FIG. 2 is a plan view from above of the machine of FIG. 1 according to the invention.

The machine 11 comprises essentially a support structure 12 on which there are mounted a printing head 13 provided with a doctor blade 14 and a scraper 15, and a replaceable silk-screen frame 16. The upper part of the support structure 12 defines a printing table 17 on which are positioned the individual products to be printed, indicated schematically by 18. The printing table 17 according to the present invention is provided with a plurality of grooves or recesses 19 having respective closure or cover elements 20. The closure elements 20 can be moved vertically by actuators 21, such as cylinders, between a raised position in which they restore the flat surface of the printing table 17 and a lowered position in which the grooves 19 are exposed To the side of the actual silk-screen printing machine 11 there is provided a conveyor or a depositing and collecting element 22 for the printed product 18. Specifically, on uprights 23 straddling the conveyor 22 there is positioned a crosspiece 24 carrying a series of gripping elements 25, such as suckers located at the end of rods, able to lowerly grip the printed product 18 and move it into the required position. More precisely, the crosspiece 24 and the relative gripping elements 25 are usually located in the end position shown in FIG. 2, and only when the product has been printed do they move forwards, enter the grooves 19, and slightly rise so as to bring for example the suckers into contact with the underside of the printed product, so locking it to them. Only then is the bar 24 moved backwards to hence drag the printed product above the conveyor 22.

When the product 18 is completely above the conveyor 22, the suckers of the griping elements 25 are deactivated to leave the product on the conveyor.

Simultaneously a new product 18 to be printed is located on the printing table 17, the upper surface of which has been restored to a continuous surface by operating the cylinders 21, which move the closure elements 20 into a position closing the grooves 19. Only then is it possible to recommence correct printing of the product 18 by means of the printing head 13, with operation of the doctor blade 14 and the scraper 15.

In a machine according to the present invention it is hence possible to obtain a silk-screen print with absolutely safe removal of the printed product without the danger of scoring the upper surface of the totally printed product.

The gripping elements can be of a different type provided they act on the lower surface of the product to be printed, without leaving the scope of protection of the present invention.

Likewise, as stated, the conveyor 22 can simply be a depositing and collecting surface such as a table or the like.

I claim:

1. A silk-screen printing machine with safe removal of the printed product, comprising: a support structure, a printing head provided with a doctor blade and scraper and on which a silk-screen frame can be positioned, a printing table and, located to the side of said printing table, an element for depositing and collecting the printed product, said printing table being provided with a plurality of grooves, into said grooves there being insertable gripping elements which can be moved between a position in correspondence with said depositing and collecting element and a position inside said grooves.

2. A machine as claimed in claim 1, wherein: within said grooves there are provided closure elements raisable and lowerable between a position aligned with said printing table and a lowered position.

3. A machine as claimed in claim 1, wherein: said gripping elements consist of suckers positioned at the end of rods rockable about a crosspiece movable above said depositing and collecting element.

4. A machine as claimed in claim 1, wherein: said depositing and collecting element is a conveyor.

5. A machine as claimed in claim 1, wherein: said depositing and collecting element is a depositing surface or table.

* * * * *